United States Patent [19]

Speranzin

[11] 4,023,337

[45] May 17, 1977

[54] DEVICE FOR DISTRIBUTING SOFTENING LIQUID ON THE YARN DURING THE TWISTING PROCESS

[75] Inventor: Claudio Speranzin, Pordenone, Italy

[73] Assignee: Officine Savio, S.p.A., Udine, Italy

[22] Filed: Dec. 11, 1975

[21] Appl. No.: 639,979

[30] Foreign Application Priority Data

Dec. 11, 1974 Italy ..... 83447/74

[52] U.S. Cl. ..... 57/35

[51] Int. Cl.[2] ..... D01H 13/30; D01H 7/86

[58] Field of Search ..... 57/34 R, 35, 58.49, 57/58.7, 58.83, 106, 108, 164

[56] References Cited

UNITED STATES PATENTS

| | | | |
|---|---|---|---|
| 3,159,962 | 12/1964 | Franzen | 57/35 X |
| 3,295,305 | 1/1967 | Nimtz | 57/58.49 |
| 3,295,306 | 1/1967 | Rehn | 57/164 X |
| 3,429,113 | 2/1969 | Nimtz et al. | 57/35 X |
| 3,563,019 | 2/1971 | Greive et al. | 57/164 X |
| 3,638,415 | 2/1972 | Andrews | 57/164 X |

*Primary Examiner*—Donald Watkins
*Attorney, Agent, or Firm*—Stevens, Davis, Miller & Mosher

[57] ABSTRACT

A device for distributing softening liquid to a yarn during the process of balloon twisting the yarn after the yarn has emerged from the spindle or from the core of the spindle including a container, at least one feeder means for feeding liquid, at least one chamber integrally fixed to an external portion of said container and a coordinated set of seepage holes present in the surface of said container communicating the inner surface of said container with said chamber wherein said chamber is supplied with liquid under adustable pressure.

14 Claims, 7 Drawing Figures

DEVICE FOR DISTRIBUTING SOFTENING LIQUID ON THE YARN DURING THE TWISTING PROCESS

The present invention relates to a device for distributing softening liquid on the yarn during the twisting process. More particularly, the invention relates to a device suitable for ensuring constant dampening of the yarn on a double-twist twisting frame.

The softening liquid is distributed mainly on the yarn during twisting so as to permit a higher speed without dust and with an equal quality in the product treated.

Present techniques arrange for special devices to replace the early systems which immersed the yarn.

The devices consist substantially of an element containing the liquid to impregnate the yarn. The element is disposed near the balloon which forms during the twisting process. The container element is equipped with means to spread the liquid over a surface on which the balloon itself slides.

An obvious disadvantage of such a system is that the softening liquid is caused to seep through onto the surface where the balloon slides. It is not taken up by the yarn and drops onto the twisting frame, thus forming together with the dust unwanted deposits, which mean damage to the functioning of the machines without taking into account the considerable consequent waste of liquid.

Therefore one object of the present invention is to arrange for means to collect excess liquid and thus to avoid the aforesaid disadvantage.

A further object is the realization of direct inflow of the liquid onto the surface whereon the balloon slides, thus avoiding the use of containers drip-feeding the liquid near the area where the balloon is formed.

A further object is the ability to supply the softening liquid in a desired quantity continuously to the yarn along the entire quantity of the yarn itself.

In fact it is an advantage to be able to avoid having deposits caused by excess softening liquid on the machines, thus preventing consequent waste and damaging deposits.

A further advantage is the fact that the softening is homogeneous since the liquid is not allowed to remain for a certain period in a collection means.

Still yet another advantage is to be able to supply softening liquid continuously and to apply the softening process to the whole yarn.

Also it is an advantage to be able to regulate the amount of softening liquid supplied to the yarn.

A still further advantage is to maintain all of the foregoing benefits when twisting is carried out both in the form of S and Z.

The objects and the consequent advantages together with further objects and advantages are obtained with a device for distributing softening liquid on the yarn during the process of twisting said yarn, as soon as the yarn has emerged from the spindle or core of the spindle and while the balloon in the process of formation is sliding on the inner sliding surface of the container. The device is characterized by including in reciprocal combination and cooperation at least one means for feeding liquid, the means having a chamber integrally fixed to an external portion of the surface whereon the balloon slides and communicating with the inner sliding surface by means of a coordinated set of seepage holes present in the surface. There may be also a chamber element to collect the excess liquid. This element is positioned below the feeding means and corresponds with a small collection window present in the container of the balloon and below the coordinated set of holes. The chambered means for feeding liquid is supplied with liquid by means of adjustable pressure.

The invention will now be better described by making reference to the accompanying drawings which has been supplied for non-limitative, exemplificative purposes and represents a preferred solution, in which.

Figure 4:
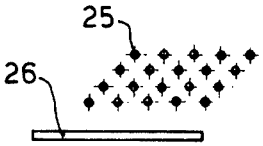
Figure 5:
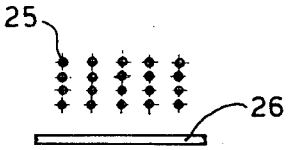
Figure 6:
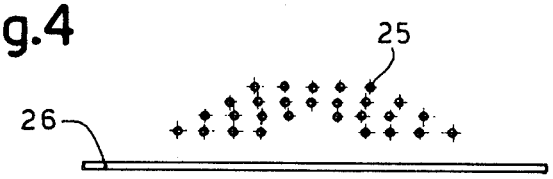
Figure 7:
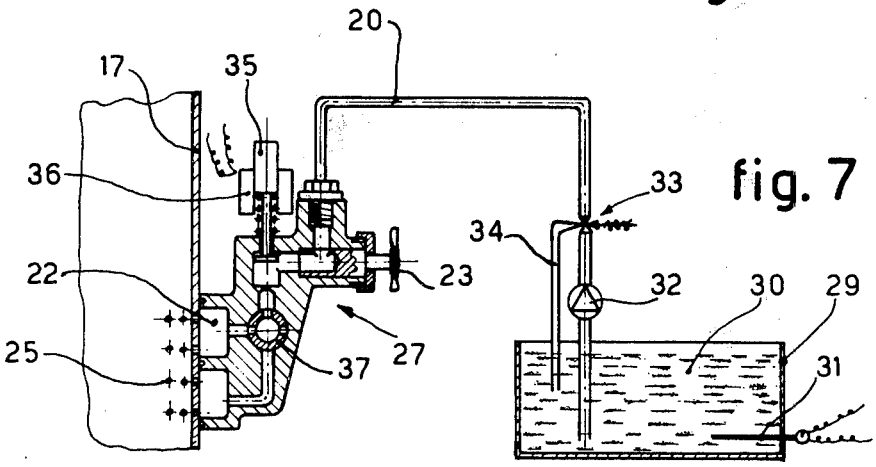

FIGS. 4, 5 and 6 give a front view of some preferential lay-outs of the seepage holes and of the collection window; and FIG. 7 shows another embodiment connected to a typical delivery plant.

In the figures the same parts or parts performing the same functions are referenced with the same numbers.

Figure 1:
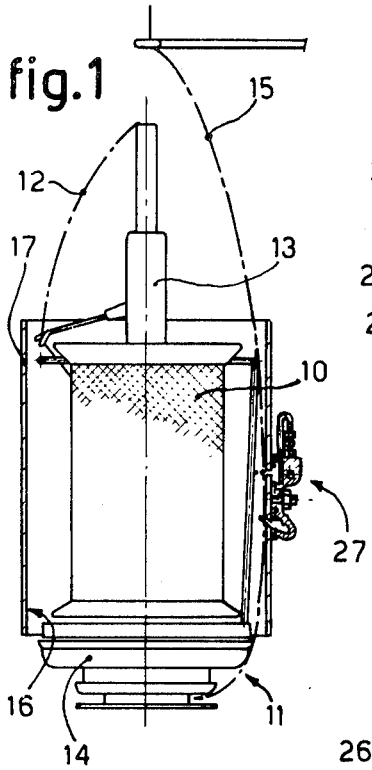
FIG. 1 shows the bobbin being fed in a double-twist twisting frame equipped with a device in accordance with the invention.

With reference to FIG. 1, bobbin 10 is fed and positioned on the head of the twisting frame. Yarn 12 is drawn off the bobbin and caused to pass through the core of the spindle 13. It is then caused to go upwards outside the bobbin and is twisted by the rotation of the yarn-guiding rotating plate 14. All of these steps are carried out in a known manner. Under these conditions the balloon 15 forms and slides on the inner surface 16 of the container 17 of the balloon.

Figure 2:
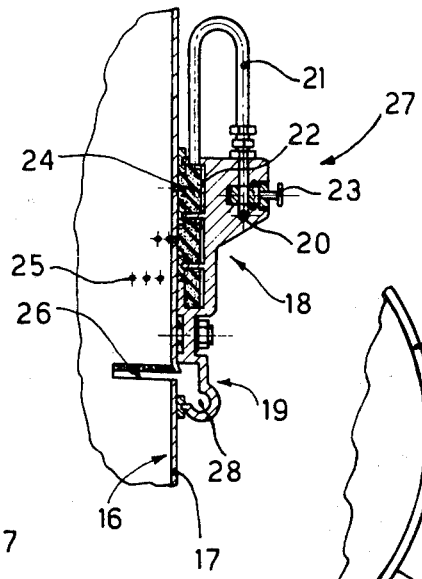
FIG. 2 shows the device in accordance with the invention illustrated in FIG. 1 but on a larger scale.
Figure 3:
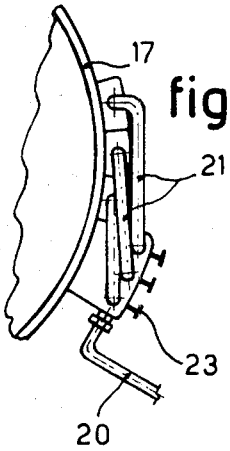
FIG. 3 shows a plan view of the device of FIG. 2 from above.

This sliding takes place on an area of the inner surface 16 of the container 17 of the balloon which is substantially intermediate and in correspondence with the device of FIG. 2 which is mounted externally of container 17.

The device consists substantially of two parts, of which the first 18 is for the receipt and supply of liquid under pressure while the second 19 serves to collect any excess liquid.

The liquid under pressure is brought to the device, generically indicated by 27, through the conduit 20 and passes therefrom through a connecting pipe 21 into a small chamber 22 next to the outer surface of the container 17 of the balloon. The connecting pipe 21 is arranged to be equipped with a device 23 for controlling the flow. This device 23 may be substantially a tap or system for regulating the pressure. In the example shown the connecting pipe 21 rests within the small chamber 22 on a porous septum 24. The porous septum, however, may be omitted where it is not desired to arrange for a coarser type of adjustment and construction.

The porous septum 24 communicates direct with the inner surface 16 of the container 17 of the balloon by means of a set of seepage holes 25, through which the liquid seeps. If the liquid is not taken up by the balloon 15 of the yarn 12, it runs down the inner surface 16 until it reaches a collection window 26.

During its course the balloon 15 slides over the vertical portion of the inner surface 16 and is impregnated with liquid in a homogeneous manner, thus obtaining the desired characteristics. From this it appears that only the excess liquid is collected by the collection window 26. When the delivery pressure of the liquid has been well adjusted for the density of the liquid to be delivered, for the setting of the holes 25 and for the speed of the yarn 12, the excess of liquid can be eliminated. The window 26 communicates with the second portion 19 of the device, this portion consisting of a conveying channel 28 through which the liquid, suitably filtered, may be returned to the circuit. So as to obtain a more homogeneous distribution of the softening liquid, the rows of holes 25 may be more than one in number and may be disposed in any of a number of lay-outs for e.g. as provided for in FIGS. 4 to 6.

The rows of holes 25 may all be set to function all of the time or may be arranged to function as required, depending on the yarn to be treated, its twisting speed and on other factors. Thus each row of holes 25 may be connected, independently from other rows, to the main feeder channel 20 through a chamber 22, and each connecting conduit 21 may have independent adjustment and cut-out means 23.

FIG. 7 shows a variant from the invention which does not provide for the part 19 for collection of excess liquid.

In accordance with this solution the device is provided with valve means which are conditioned by the yarn 12 as the latter is twisted. In fact the experiments of the authors of this invention show that a seepage of softening liquid takes place only when the yarn 12 breaks or ends, namely when the balloon 15 does not brush against the inner surface 16 and take away the softening liquid.

In accordance with FIG. 7 the device 27 is foreseen to have a feed pipe 20 connected to a tank 29, which contains softening liquid 30 kept at a given temperature by thermostat means 31, through a pump 32, which may have downstream from itself a pressure regulator 33 with a discharge conduit 34; a regulating or shut-off tap 23; a valve 35, controlled mechanically or pneumatically or electrically, for example through an electric suction means 36, by the presence of the yarn 12 being twisted; a distribution tap 37, which may put one or more chambers 22 into communication with the delivery conduit 20; one or more coordinated sets of holes 25 for each chamber 22; and means with porous septa 24 may perhaps be provided within the chambers 22 to obtain better dosage of the softening liquid. By means of the device of FIG. 7 the wasteage of softening liquid which takes place when the yarn 12 is not being processed is avoided.

To control the valve 35 mechanically it is possible to use either the feeler means or the bobbin-lifter or both. Connection is made by means of kinematic motions of a known type.

It also is obvious to apply numerous modifications to the invention without thereby departing from the field of the invention.

Thus it is possible to alter the shape and sizes of the device; the container of the balloon could be arranged to be suitable for the installation of more than one delivery device. It would be possible to provide for the device even to be able to cooperate with the whole circumference of the container.

The system for adjusting the pressure and flow could be varied, as also could the shape of the connecting pipe, and so on.

The porous septum could also be omitted, and the flow of the supply could be arranged to be regulated directly by means of a suitable tap of a known type without thereby departing from the scope of the inventive idea.

What is claimed is:

1. A device for distributing softening liquid to a yarn, during the process of balloon twisting the yarn, after the yarn has emerged from a spindle or from a core of the spindle, comprising a container, at least one feeder means for feeding liquid, at least one chamber integrally fixed to an external portion of said container and a coordinated set of seepage holes present in the surface of said container, communicating the inner surface of said container with said chamber, wherein said chamber is supplied with liquid under adjustable pressure.

2. The device according to claim 1, including below the set of seepage holes a chambered element for collecting excess liquid, said element being positioned below said feeder means and a collection window present in the container below the coordinated set of holes connecting with said element.

3. The device according to claim 1, including means which intercept the liquid, regulate and condition the flow of the supply thereof and a delivery conduit located upstream from the chamber.

4. The device according to claim 1, including a porous septum provided upstream from the seepage holes and within the chamber.

5. The device according to claim 1, including a delivery conduit and a distributor tap between the chamber and the delivery conduit.

6. The device according to claim 5, including a valve between the delivery conduit and the distributor tap which is controlled by the yarn being twisted.

7. The device according to claim 6, wherein said valve is operated mechanically by means of levers.

8. The device according to claim 6, wherein said valve is operated pneumatically.

9. The device according to claim 6, wherein said valve is operated electrically.

10. The device according to claim 6, including feeler means to operate the valve.

11. The device according to claim 5, including a pump and tank upstream of said delivery conduit wherein the delivery conduit is continuously fed under constant adjustable pressure by said pump which draws up liquid from said tank holding softening liquid at a constant adjustable temperature.

12. The device according to claim 2, wherein said collection window extends by a substantially equal and symmetrical portion below the line of seepage holes.

13. The device according to claim 2, including a tank and wherein said chambered collection element has a conveying withdrawal conduit connected to said tank holding softening liquid.

14. The device according to claim 6, including a bobbin-lifter to operate the valve.

* * * * *